US005504832A

United States Patent [19]

Taguchi

[11] Patent Number: 5,504,832

[45] Date of Patent: Apr. 2, 1996

[54] REDUCTION OF PHASE INFORMATION IN CODING OF SPEECH

[75] Inventor: Tetsu Taguchi, Tokyo, Japan

[73] Assignee: NEC Corporation, Tokyo, Japan

[21] Appl. No.: 995,704

[22] Filed: Dec. 23, 1992

[30] Foreign Application Priority Data

Dec. 24, 1991 [JP] Japan ..... 3-341429

[51] Int. Cl.[6] ..... G10L 9/00

[52] U.S. Cl. ..... 395/2.1; 395/2.15; 395/2.38

[58] Field of Search ..... 395/2.1, 2.14, 395/2.15, 2.16, 2.38, 2.39, 2.74; 381/36, 38

[56] References Cited

U.S. PATENT DOCUMENTS

| | | | |
|---|---|---|---|
| 4,184,049 | 1/1980 | Crochiere et al. | 395/2.38 |
| 4,850,022 | 7/1989 | Honda et al. | 395/2.16 |
| 5,089,818 | 2/1992 | Mahieux et al. | 341/76 |
| 5,226,083 | 7/1993 | Taguchi | 381/36 |
| 5,394,473 | 2/1995 | Davidson | 381/36 |

OTHER PUBLICATIONS

N. S. Jayant et al., "Digital Coding of Waveforms—Principles and Applications to Speech and video", 1984, Prentice–hall, Inc. in U.S.A., pp. 563–576.

*Primary Examiner*—Allen R. MacDonald
*Assistant Examiner*—Thomas J. Onka
*Attorney, Agent, or Firm*—Sughrue, Mion, Zinn, Macpeak & Seas

[57] ABSTRACT

In an encoding device (100) operable in response to an input speech signal by means of an adaptive transform coding to produce an output encoded speech signal, the input speech signal is partitioned into data blocks by a partition circuit (113). Each of data blocks is decomposed into a plurality of frequency components by a Fourier transformer (114). A spectral envelope calculator (120) estimates intensity of a spectral envelope of the input speech signal. In cooperation with a scalar spectral calculator (115) and a bit assignment determiner (121), a quantizer (116) quantizes or encodes the frequency components with phase information selectively removed from a part of the frequency components on the basis of the intensity of the spectral envelope. In a decoding device, a phase information assignor assigns pseudo-phase information to each of the frequency components from which the phase information is selectively removed.

18 Claims, 4 Drawing Sheets

REDUCTION OF PHASE INFORMATION IN CODING OF SPEECH

BACKGROUND OF THE INVENTION

This invention relates to a speech encoding method and a device therefor. The speech encoding method or technique is for encoding an input speech signal into an output encoded speech signal. The output encoded speech signal is either for transmission through a transmission channel or for storage in a storing medium.

This invention also relates to a method of decoding the output encoded speech signal into an output speech signal, namely, into a replica of the input speech signal, and to a decoder for use in carrying out the decoding method. The output encoded speech signal is supplied to the decoder as an input encoded speech signal and is decoded into the output speech signal by synthesis.

Speech encodings is well known as adaptive transform coding (ATC) in the art. The adaptive transform coding is, for example, described by N. S. Jayant et al. in a book of "*DIGITAL CODING OF WAVEFORMS, Principle and Applications to Speech and Video*", 1984, PRENTICE-HALL, INC. in U.S.A., pages 563–576 in Chapter 12 thereof, under the title of "12.7 *Adaptive Transform Coding of Speech and Images*". In the adaptive transform coding of speech, an input speech signal is partitioned or divided into data blocks by using a time window such as a rectangular window. Each of data blocks is decomposed into a plurality of frequency components by means of an orthogonal transformation such as Discrete Fourier Transform (DFT), Discrete Walsh Hadamard Transform (DWHT), Discrete Cosine Transform (DCT), Karhunen Loeve Transform (KLT), or the like. The frequency components are adaptively quantized or encoded on the basis of intensity of a spectral envelope of the data block in question with a quantization bit number (the number of quantum levels) selectively assigned to each frequency component.

On the other hand, on decoding the encoded speech signal, the encoded speech signal is converted into the frequency components. The frequency components are successively composed into the data blocks. And then, the data blocks are coupled to produce a replica of the input speech signal.

In this connection, a frequency component having relatively high intensity of the spectral envelope is assigned with the quantization bit number indicating a lot of bits while a frequency component having relatively low intensity of the spectral envelope is assigned with the quantization bit number indicating few bits. It is to be noted that each frequency component always has phase information as well as amplitude information in a conventional encoder. Under the circumstances, bit assignment is insufficiently made as regards the frequency component having relatively low intensity of the spectral envelope in a case where the encoder has a low encoding speed. As a result, on decoding the encoded speech signal encoded by the conventional encoder, a conventional decoder decodes the encoded speech signal into the replica of the input speech signal accompanied by the sense of unnatural hearing. Accordingly, it results in degradation of a speech quality.

SUMMARY OF THE INVENTION

It is therefore an object of this invention to provide a method wherein bit assignment is sufficiently made as it regards a frequency component having relatively low intensity of a spectral envelope in a case where an encoder has a low encoding speed.

It is another object of this invention to provide a method of the type described, it is possible for a decoder to decode an input encoded speech signal into an output speech signal accompanied by the sense of natural hearing.

It is still another object of this invention to provide a method of the type described, which is capable of improving a speech quality.

It is yet another object of this invention to provide an encoder which is capable of encoding an input speech signal into an output encoded speech signal wherein bit assignment is sufficiently made as regards a frequency component having relatively low intensity of a spectral envelope in a case where the encoder has a low encoding speed.

It is a further object of this invention to provide a decoder which is communicable with an encoder of the type described and which can naturally reproduce the input speech signal with a high fidelity.

It is a still further object of this invention to provide a decoder of the type described, in which it is possible to avoid degradation of a speech quality.

On describing the gist of an aspect of this invention, it is possible to understand that a method of encoding an input speech signal into an output encoded speech signal by means of an adaptive transform coding technique and of decoding the output encoded speech signal into a replica of the input speech signal.

According to the above-mentioned aspect of this invention, the above-understood method comprises the steps of: (1) partitioning the input speech signal into data blocks by using a time window, (2) decomposing each of the data blocks into a plurality of frequency components by means of an orthogonal transformation, (3) adaptively quantizing the frequency components on the basis of the intensity of a spectral envelope of the data block in question into an output encoded speech signal (with phase information selectively removed from a part of the frequency components that has intensity less than a predetermined level), (4) converting the output encoded speech signal into frequency components with pseudo-phase information assigned to the part of the frequency components having no phase information, (5) composing the frequency components to successively produce the data blocks, and (6) coupling the data blocks to produce the replica of the input speech signal.

On describing the gist of a different aspect of this invention, it is possible to understand that an encoding device is for use in encoding an input speech signal into an output encoded speech signal.

According to a different aspect of this invention, the afore-understood encoding device comprises sampling means for sampling the input speech signal at a predetermined sampling frequency to produce a sampled signal. The sampling means converts the sampled signal into a digitally coded signal. Connected to the sampling means, an analyzing means analyzes the digitally coded signal into quantized K parameters, decoded $\propto$ parameters, a quantized power coefficient, and a quantized decoded power coefficient. Connected to the sampling means and the analyzing means, a whitening means whitens the digitally coded signal on the basis of the decoded $\propto$ parameters to produce a whitened signal. Connected to the whitening means, a partitioning means partitions the whitened signal into data blocks. Connected to the partitioning means, a transforming means transforms each of the data blocks into complex and scalar spectral signals which indicate complex and scalar spectrum for each data block, respectively. The complex spectrum consists of frequency components each of which have both of the phase information and the amplitude information while the scalar spectrum consists of frequency components each of which has amplitude information alone. Connected to the analyzing means, assignment means calculates a spectral envelope for each data block on the basis of the decoded ∝ parameters and for determining bit assignment on the basis of the spectral envelope to produce a bit assignment signal indicative of the bit assignment and a selection signal indicating whether or not the phase information is removed from each frequency component. Connected to the assignment means, the transforming means, and the analyzing means, the quantizing means selectively quantizes, in response to the selection signal, one of the complex and the scalar spectral signals on the basis of the bit assignment signal by using the quantized decoded power coefficient to produce a quantized spectral signal. Connected to the quantizing means and the analyzing means, a multiplexing means multiplexes the quantized spectral signal, the quantized K parameters, and the quantized power coefficient into the output encoded speech signal.

On describing the gist of a further aspect of this invention, it is possible to understand that a decoding device is for use in combination with the above-mentioned encoding device, to decode the output encoded speech signal into an output speech signal as a replica of the input speech signal.

According to the further aspect of this invention, the above-understood decoding device comprises a demultiplexing means for demultiplexing the output encoded speech signal into the quantized spectral signal, the quantized power coefficient, and the quantized K parameters. Connected to the demultiplexing means, a K decoding circuit decodes the quantized K parameters into the quantized decoded K parameters. Connected to the K decoding circuit, a K/∝ converter converts the quantized decoded K parameters into the decoded ∝ parameters. Connected to the K/∝ converter, an assignment means calculates a spectral envelope for each data block on the basis of the decoded ∝ parameters and determines bit assignment on the basis of the spectral envelope to produce a bit assignment signal indicative of the bit assignment and a selection signal indicating whether or not the phase information is removed from each frequency component. Connected to the demultiplexing means, a power decoding circuit decodes the quantized power coefficient into the quantized decoded power coefficient. Connected to the power decoding circuit, the assignment means, and the demultiplexing means, a decoding circuit decodes the quantized spectral signal on the basis of the bit assignment signal and the selection signal by using the quantized decoded power coefficient into a spectral signal indicative of frequency components which are classified into first and second groups. Each of the frequency components belonging to the first group has the phase information as well as the amplitude information while each of the frequency components belonging to the second group has the amplitude information alone. Connected to the decoding circuit and the assignment means, a phase information assignor assigns pseudo-phase information to the frequency components of the second group to produce, as a reproduced complex spectral signal, a combination of the first group and the second group assigned with the pseudo-phase information. Connected to the phase information assignor, an inverse transforming means inverse transforms the reproduced complex spectral signal into data blocks indicative of a whitened speech signal. Connected to the inverse transforming means, a buffer memory temporarily stores the data blocks and reads the stored data blocks out thereof as readout data. Connected to the buffer memory and the K/∝ converter, a synthesizing means synthesizes the readout data on the basis of the decoded ' parameters into a reproduced coded signal. Connected to the synthesizing means, a converting means converts the reproduced coded signal into the output speech signal.

DESCRIPTION OF THE PREFERRED EMBODIMENT

Figure 1:
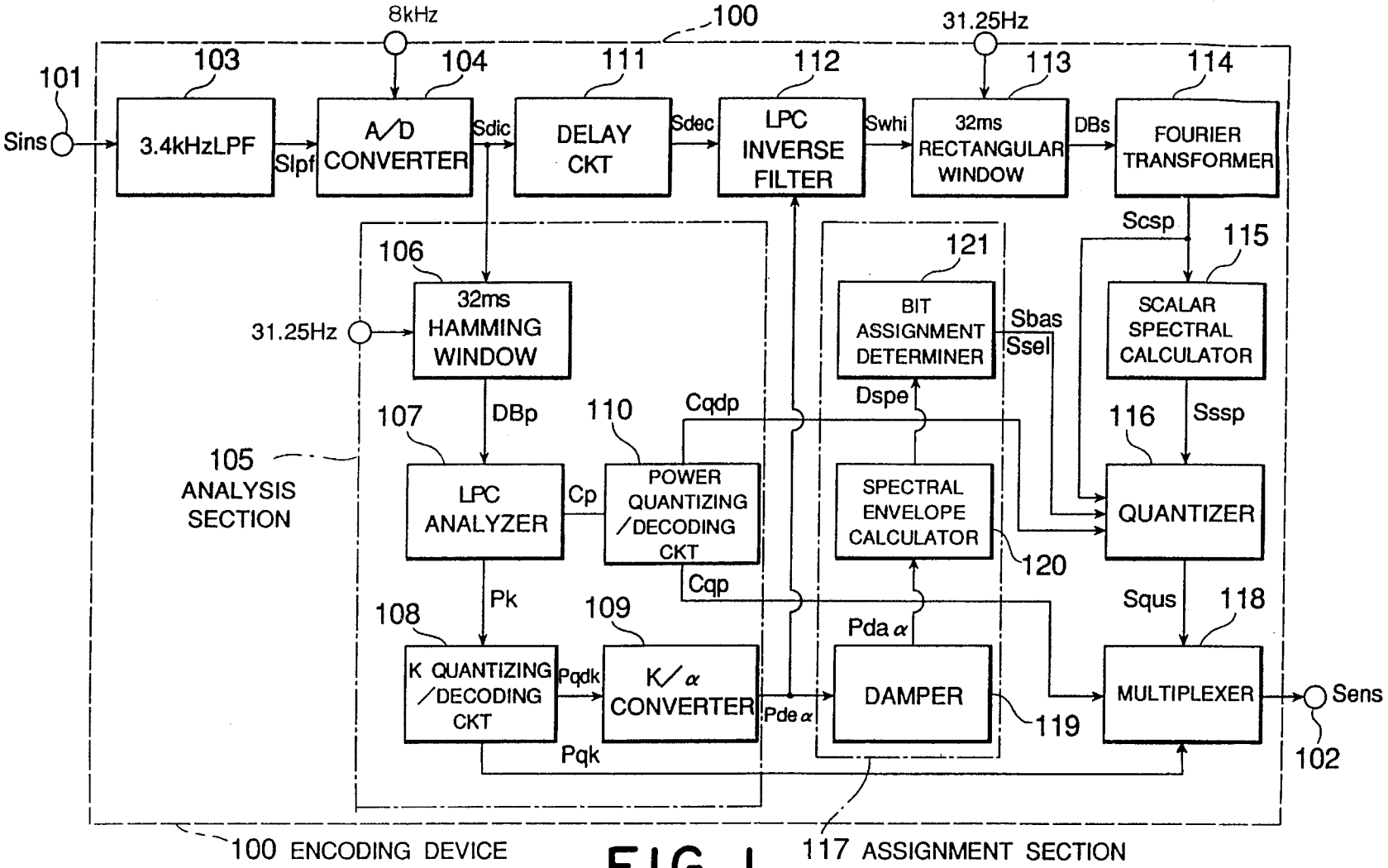
FIG. 1 is a block diagram of an encoding device for use in a method according to an embodiment of this invention.

Referring to FIG. 1, an encoding device 100 is for use in a method according to a first embodiment of this invention. The encoding device 100 has a speech input terminal 101 supplied with an input speech signal Sins. The encoding device 100 encodes the input speech signal Sins in accordance with adaptive transform coding (ATC) into an output encoded speech signal Sens. The encoding device 100 has a data output terminal 102 for producing the output encoded speech signal Sens. The encoding device 100 may be called a speech analyzer section.

The encoding device 100 comprises a low-pass filter (LPF) 103 having a predetermined cutoff frequency $f_c$, e.g. 3.4 kHz. Supplied with the input speech signal Sins from the speech input terminal 101, the low-pass filter 103 carries out a low-pass filtering on the input speech signal Sins to produce a low-pass filtered signal Slpf having a frequency band which is restricted to the predetermined cutoff frequency $f_c$. The low-pass filtered signal Slpf is supplied to an analog-to-digital (A/D) converter 104. The analog-to-digital converter 104 samples the low-pass filtered signal Slpf at a predetermined sampling frequency $f_s$, e.g. 8 kHz to produce a sampled signal and then converts the sampled signal into a digitally coded signal Sdic. At any rate, a combination of the low-pass filter 103 and the analog-to-digital converter 104 serves as a sampling arrangement for sampling the input speech signal Sins as the predetermined sampling frequency to produce the sampled signal and converting the sampled signal into the digitally coded signal Sdic.

The digitally coded signal Sdic is supplied to an analysis section 105. The analysis section 105 comprises a first partition circuit 106, a linear predictive coding (LPC) analyzer 107, a K quantizing/decoding circuit 108, a K/∝ converter 109, and a power quantizing/decoding circuit 110. Supplied with the digitally coded signal Sdic from the analog-to-digital converter 104, the first partition circuit 106 partitions or divides the digitally coded signal Sdic for each LPC frame period $P_f$, e.g. 32 ms (which corresponds to a frame frequency of 31.25 Hz) by using a Hamming window having a window length of 32 ms into a sequence of primary data blocks DBp or primary data segments. The primary data blocks DBp are supplied to the linear predictive coding analyzer 107.

Supplied with the primary data blocks DBp from the partition circuit 106, the linear predictive coding analyzer 107 carries out an LPC analysis operation on the primary data blocks DBp by using an auto-correlation method to calculate both of a sequence of ∝ parameters of ten orders and a sequence of K parameters Pk of ten orders. The ∝ parameters are referred to as LPC parameters or predictor coefficients, as is well known in the art. The K parameters are called partial correlation (PARCOR) coefficients, as is well known in the art. The K parameters Pk are supplied to the K quantizing/decoding circuit 108. On carrying out the LPC analysis operation, the linear predictive coding analyzer 107 obtains a power coefficient Cp which is supplied to the power quantizing/decoding circuit 110.

Supplied with the K parameters Pk of ten orders from the linear predictive coding analyzer 107, the K quantizing/decoding circuit 108 quantizes the K parameters Pk into a sequence of quantized K parameters Pqk. Subsequently, the K quantizing/decoding circuit 108 decodes the quantized K parameters Pqk into a sequence of quantized decoded K parameters Pqdk each of which includes a quantizing error. The quantized decoded K parameters Pqdk are supplied to the K/∝ converter 109. The K/∝ converter 109 converts the quantized decoded K parameters Pqdk into a sequence of decoded ∝ parameters Pde∝.

Supplied with the power coefficient Cp from the linear predictive coding analyzer 107, the power quantizing/decoding circuit 110 quantizes the power coefficient Cp into a quantized power coefficient Cqp. Subsequently, the power quantizing/decoding circuit 110 decodes the quantized power coefficient Cqp into a quantized decoded power coefficient Cqdp which includes a quantizing error.

The digitally coded signal Sdic is also supplied to a delay circuit 111 from the analog-to-digital converter 104. The delay circuit 111 has a delay time equal to a processing time in the analysis section 105. The delay circuit 111 delays the digitally coded signal Sdic into a delayed coded signal Sdec. The delayed coded signal Sdec is supplied to an LPC inverse filter 112. The LPC inverse filter 112 is also supplied with the decoded ∝ parameters Pde∝ from the K/∝ converter 109 as a sequence of filter coefficients for each LPC frame. The LPC inverse filter 112 carries out an LPC inverse filtering operation on the delayed coded signal Sdec on the basis of the filter coefficients to produce a whitened signal Swhi. Therefore, the LPC inverse filter 122 may be called a whitening filter. In other words, the LPC inverse filter 112 acts in cooperation with the delay circuit 111 as a whitening arrangement for the digitally coded signal Sdic on the basis of the decoded ∝ parameters Pde∝ to produce the whitened signal Swhi. The whitened signal Swhi is supplied to a second partition circuit 113.

Supplied with the whitened signal Swhi from the LPC inverse filter 112, the second partition circuit 113 partitions or divides the whitened signal Swhi for each frame period $P_f$ of 32 ms (which corresponds to a frame frequency of 31.25 Hz) by using a rectangular window having a window length of 32 ms into a sequence of secondary data blocks DBs or secondary data segments. Each of secondary data blocks DBs consists of data of 256 points. The secondary data blocks DBs are supplied to a Fourier transformer 114.

Supplied with the secondary data blocks DBs from the second partition circuit 113, the Fourier transformer 114 carries out a Fourier transform on each secondary data block DBs to produce a complex spectral signal Scsp indicative of complex spectrum of 128 points for each secondary data block DBs. That is, each of the secondary data blocks DBs is decomposed into a plurality of frequency components by means of an orthogonal transformation. The complex spectral signal Scsp is supplied to a scalar spectral calculator 115. The scalar spectral calculator 115 converts the complex spectral signal Scsp into a scalar spectral signal Sssp indicative of scalar spectrum of 128 points for each secondary data block DBs. Both of the complex spectral signal Scsp and the scalar spectral signal Sssp are supplied to a quantizer 116. As well known in the art, the complex spectral signal Scsp indicates frequency components each of which has both of phase information and amplitude information while the scalar spectral signal Sssp indicates frequency components each of which has amplitude information alone. At any rate, a combination of the Fourier transformer 114 and the scalar spectral calculator 115 is operable as a transforming arrangement for transforming each of the secondary data blocks DBs into the complex and the scalar spectral signals.

The quantizer 116 is also supplied with the quantized decoded power coefficient Cqdp from the power quantizing/decoding circuit 110. In a manner which will later be described in more detail, the quantizer 116 is furthermore supplied with a bit assignment signal Sbas and a selection signal Ssel from an assignment section 117. The quantizer 116 selects, in response to the selection signal Ssel, one of the complex spectral signal Scsp and the scalar spectral signal Sssp at each secondary data block DBs as a selected spectral signal. Subsequently, the quantizer 116 quantizes the selected spectral signal on the basis of the quantized decoded power coefficient Cqdp and the bit assignment signal Sbas into a quantized spectral signal Squs. The quantized spectral signal Squs has a variable quantization bit number for each secondary data block DBs which is selectively assigned on the basis of intensity or strength of a spectral envelope for each secondary data block DBs in the manner which will be described as the description proceeds. The quantized spectral signal Squs is supplied to a multiplexer 118.

The multiplexer 118 is also supplied with the quantized K parameters Pqk and the quantized power coefficient Cqp from the K quantizing/decoding circuit 108 and the power quantizing/decoding circuit 110, respectively. The multiplexer 118 multiplexes the quantized spectral signal Squs, the quantized K parameters Pqk, and the quantized power coefficient Cqp into a multiplexed signal. The multiplexer 118 is connected to the data output terminal 102 which therefore produces the multiplexed signal as the output encoded speech signal Sens. The output encoded speech signal Sens is delivered through a channel (not shown) to a decoding device or a speech synthesizer section which will later be described in detail with reference to FIG. 4.

The assignment section 117 comprises a damper 119, a spectral envelope calculator 120, and a bit assignment determiner 121. The damper 119 is supplied with the decoded ∝ parameters Pde∝ from the K/∝ converter 109 and has a damping factor γ which is equal, for example, to 0.7. The damper 119 multiplies the decoded ∝ parameters Pde∝ by the damping factor γ to produce a sequence of damped ∝ parameters Pda∝. The damped ∝ parameters Pda∝ are supplied to the spectral envelope calculator 120. The spectral envelope calculator 120 calculates spectral envelope data Dspe of 128 points representative of the spectral envelope for each primary data block DBp by processing the damped ∝ parameters Pda∝. Therefore, the spectral envelope calculator 120 may be referred to a spectral envelope intensity estimating arrangement for estimating intensity of the spectral envelope of the input speech signal Sins. It is to be noted here that the spectral envelope data Dspe is spectral envelope data for a data block into which each primary data block DBp is spectral-structurally converted due to a well-known auditory weighting. The spectral envelope data Dspe is supplied to the bit assignment determiner 121. The bit assignment determiner 121 determines bit assignment for the quantizer 116 on the basis of the spectral envelope data Dspe to produce the bit assignment signal Sbas indicative of the bit assignment and the selection signal Ssel in the manner which will presently be described.

Figure 2:
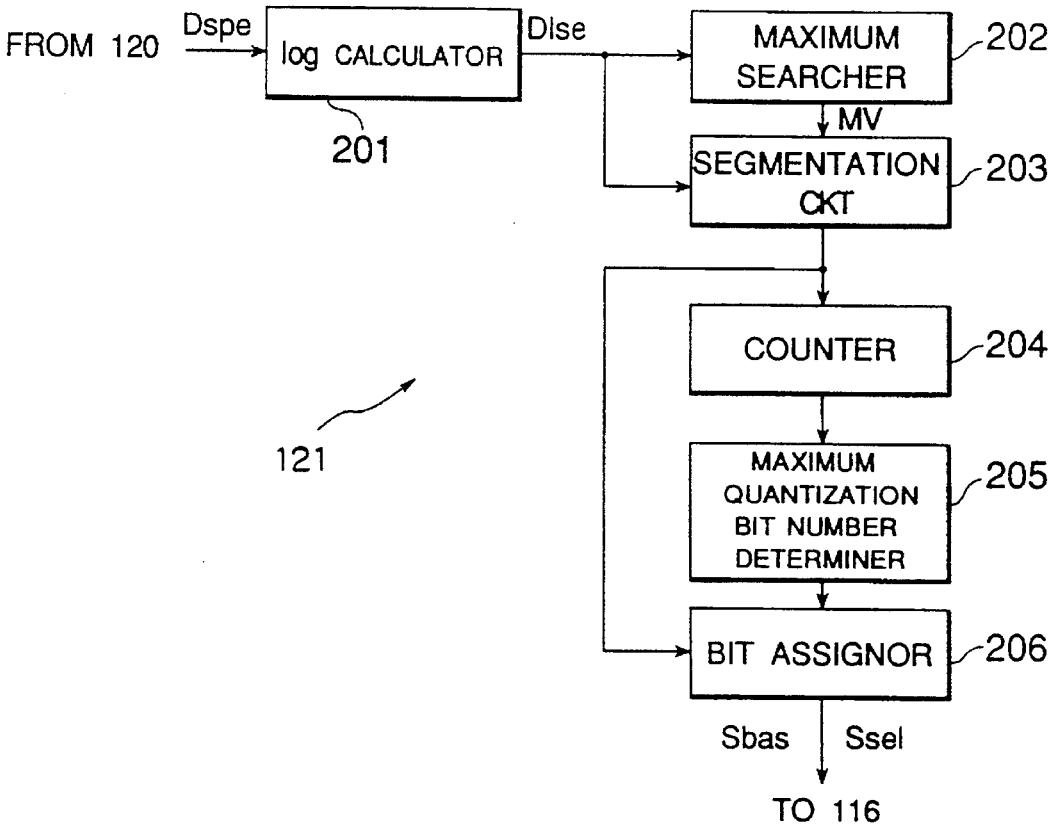
FIG. 2 is a block diagram of a bit assignment determiner for use in the encoding device illustrated in FIG. 1.

Turning to FIG. 2, the bit assignment determiner 121 comprises a logarithm calculator 201 supplied with the spectral envelope data Dspe from the spectral envelope calculator 120. The logarithm calculator 201 carries out a logarithm operation, which is formulated by 10 log (•), on the spectral envelope data Dspe of 106 points (frequency components) within a range between 125 Hz and 3405.8 Hz in 128 points thereof to produce logarithmic spectral envelope data Dlse. In the example being illustrated, the logarithm calculator 201 ignores frequency components beyond the range between 125 Hz and 3405.8 Hz. The logarithmic spectral envelope data Dlse is supplied with both a maximum searcher 202 and a segmentation circuit 203. The maximum searcher 202 searches the logarithmic spectral envelope data Dlse to detect a maximum value MV among 106 points of the logarithmic spectral envelope data Dlse. The detected maximum value MV is supplied to the segmentation circuit 203.

Figure 3:
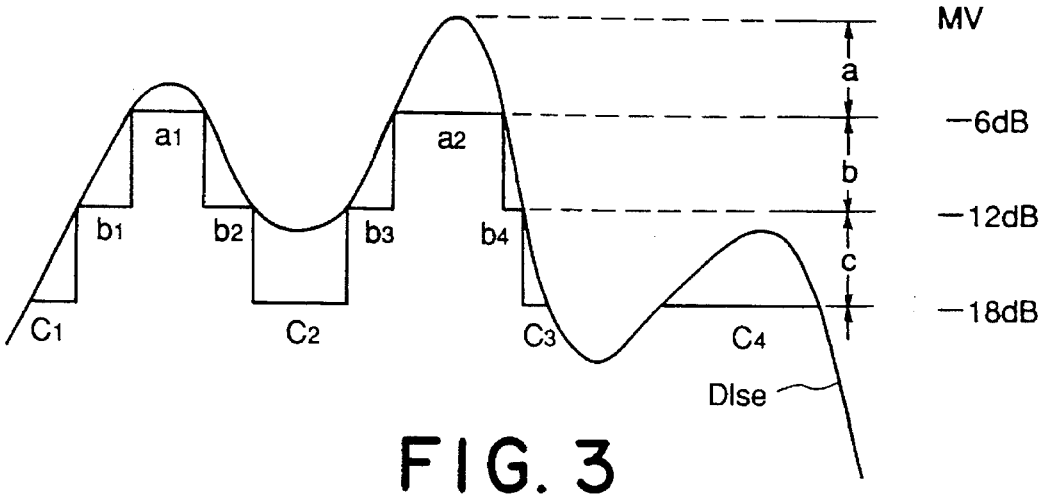
FIG. 3 shows a waveform representing logarithmic spectral envelope data for use in describing operation of a segmentation circuit in the bit assignment determiner illustrated in FIG. 2.

Turning to FIG. 3 in addition to FIG. 2, the segmentation circuit 203 segments the logarithmic spectral envelope data Dlse on the basis of the detected maximum value MV into sections at intervals of 6 dB. It is assumed that the logarithmic spectral envelope data Dlse within a section a between the maximum value MV and −6 dB is equal to (a1+a2), the logarithmic spectral envelope data Dlse within another section b between −6 dB and −12 dB is equal to (b1+b2+b3+b4), and the logarithmic spectral envelope data Dlse within still another section c between −12 dB and −18 dB is equal to (c1+c2+c3+c4). Supplied with the sections from the segmentation circuit 203, the counter 204 counts a count number of the logarithmic spectral envelope data Dlse within the section a:

$$n_0 = a1 + a2,$$

the count number of logarithmic spectral envelope data Dlse within the section b is:

$$n_1 = b1 + b2 + b3 + b4, \text{ and}$$

the count number of the logarithmic spectral envelope data Dlse within the section c is:

$$n_2 = c1 + c2 + c3 + c4.$$

These count numbers $n_0$, $n_1$, and $n_2$ are supplied to a maximum quantization bit number determiner 205. The maximum quantization bit number determiner 205 determines, on the basis of the count numbers $n_0$, $n_1$, and $n_2$, a maximum quantization bit number N which satisfies Equation (1) as follows:

$$2 \times \sum_{i=1}^{N} n_{N-i} \cdot i + n_N \leqq M \quad (1)$$

-continued $$\max(N) = 4$$

where M represents the total bit number for the quantized frequency components which can be transmitted in each frame. The maximum quantization bit number N is supplied to a bit assignor 206. The bit assignor 206 is also supplied with the sections from the segmentation circuit 203. In the manner which will presently be described in detail, the bit assignor 206 carries out bit assignment for quantization in the quantizer 116 (FIG. 1).

At first, the maximum quantization bit number determiner 205 determines the maximum quantization bit number N which satisfies Equation (2) as follows:

$$2 \times \sum_{i=1}^{N} n_{N-i} \cdot i \leqq M \quad (2)$$

where M represents the total bit number which is similar to that in the Equation (1). The bit assignor 206 assigns the maximum quantization bit number N determined by Equation (2) as a quantization bit number for $n_0$ frequency components within the section a in the logarithmic spectral envelope data Dlse. Similarly, the bit assignor 206 assigns a bit number (N−1) as another quantization bit number for $n_1$ frequency components within the section b in the logarithmic spectral envelope data Dlse. The bit assignor 206 assigns a bit number (N−2) as still another quantization bit number for $n_2$ frequency components within the section c in the logarithmic spectral envelope data Dlse. Inasmuch as each frequency component to be quantized is represented by complex data having phase information as well as amplitude information, it is necessary for each frequency component to quantize both of Sine and Cosine components thereof. For that reason, there is a coefficient "2" in the left-hand side of Equation (2). Although precision of the quantization unnecessarily becomes higher, tone quality for hearing saturates. As a result, the maximum quantization bit number N is restricted to the maximum number of "4" in the example being illustrated.

As well known in the art, there is a difference equal to or more than 40 dB between a spectral intensity of a first formant and a spectral intensity of a high-frequency range. Accordingly, a ratio of frequency components to be transmitted to all of the frequency components obtained by the orthogonal transformation becomes much less dependent on selection of the quantization bit number. For that purpose, the maximum quantization bit number determiner 205 determines the maximum quantization bit number N according to the above-mentioned Equation (1). It will be presumed that the sections a, b, c, . . . are referred to as a first section, a second section, a third section, . . . , respectively. The bit assignor 206 carries out the bit assignment, on the basis of the maximum quantization bit number N on the frequency components of the spectral envelope data within any section between the first section and an N-th section, both inclusive, so as to transmit the phase information thereof. On the other hand, the bit assignor 206 assigns the quantization bit number of one bit for $n_N$ frequency components within an (N+1)-th section of the spectral envelope data with the phase information thereof removed. At any rate, the bit assignment determiner 121 produces the bit assignment signal Sbas representative of the quantization bit number and the selection signal Ssel indicating whether or not the phase information is removed from each frequency component. The bit assignment signal Sbas and the selection signal Ssel are supplied to the quantizer 116 (FIG. 1).

Turning back to FIG. 1, when the selection signal Ssel indicates that the phase information is removed from each frequency component, the quantizer 116 quantizes the scalar spectral signal Sssp supplied from the scalar spectral calculator 115 on the basis of the bit assignment signal Sbas by using the quantized decoded power coefficient Cqdp. When the selection signal Ssel indicates that the phase information is not removed from each frequency component, the quantizer 116 quantizes the complex spectral signal Scsp supplied from the Fourier transformer 114 on the basis of the bit assignment signal Sbas by using the quantized decoded power coefficient Cqdp. Therefore, a combination of the scalar spectral calculator 115, the quantizer 116, and the bit assignment determiner 121 serves as an encoding arrangement for encoding the frequency components with the phase information selectively removed from a part of the frequency components on the basis of the intensity of the spectral envelope estimated by the spectral envelope calculator 120. The quantizer 116 delivers the quantized spectral signal Squs to the multiplexer 118. The multiplexer 118 multiplexes the quantized spectral signal Squs supplied from the quantizer 116, the quantized power coefficient Cpq supplied from the power quantizing/decoding circuit 110, and the quantized K parameters Pqk supplied from the K quantizing/decoding circuit 108 and sends the multiplexed signal to the channel from the data output terminal 102 as the output encoded speech signal Sens to transmit to the decoding device or the speech synthesizer section.

Figure 4:
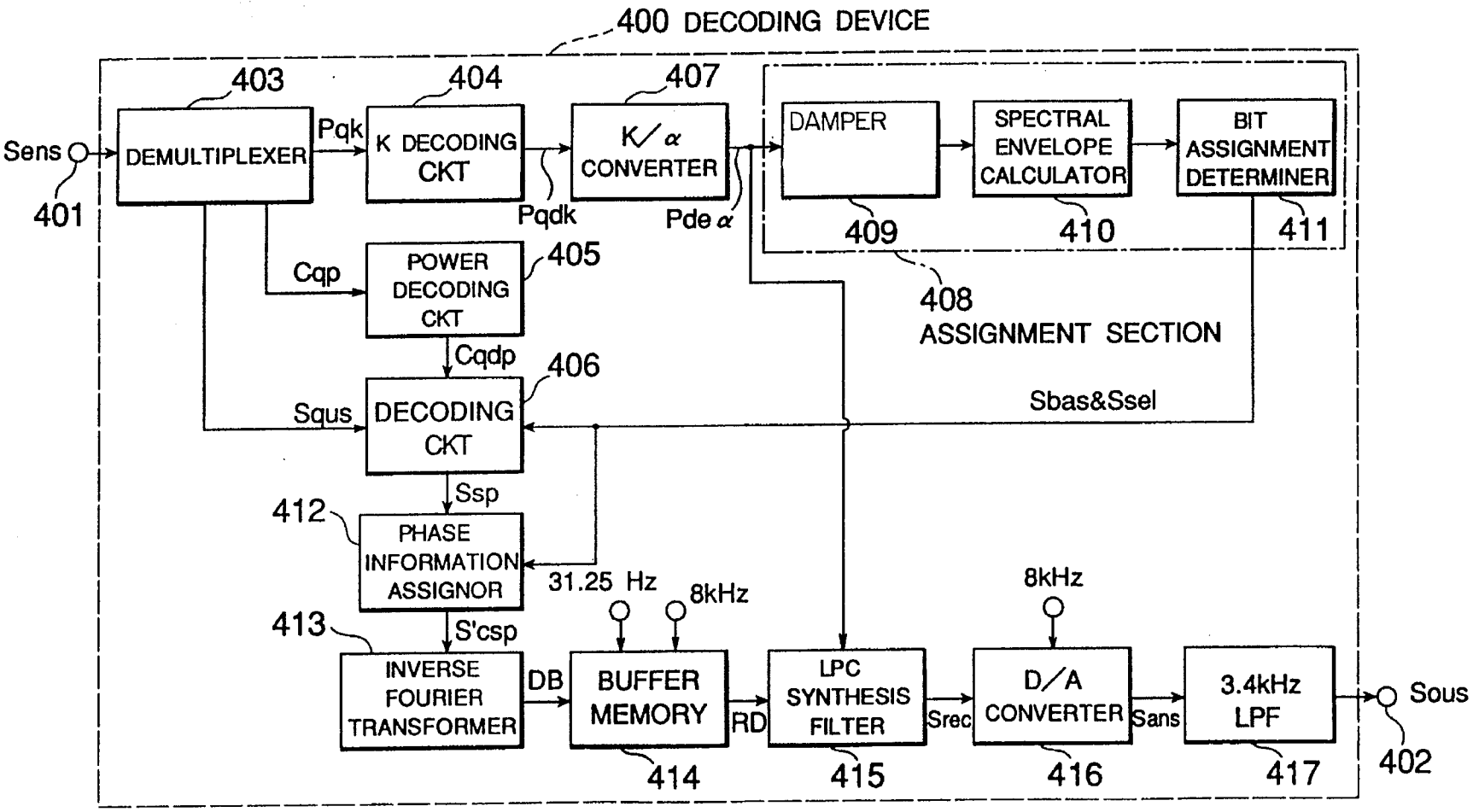
FIG. 4 is a block diagram of a decoding device for use in combination with the encoding device illustrated in FIG. 1.

Referring to FIG. 4, the decoding device depicted at 400 is for use in combination with the encoding device 100 illustrated with reference to FIGS. 1 and 2. The decoding device 400 has a data input terminal 401 supplied as an input encoded speech signal with the output encoded speech signal Sens given from the encoding device 100. The decoding device 400 decodes the input encoded speech signal Sens into an output speech signal Sous as a replica of the input speech signal Sins. The decoding device 400 has a speech output terminal 402 for producing the output speech signal Sous. The decoding device 400 may be referred to as the speech synthesizer section as mentioned above.

The decoding device 400 comprises a demultiplexer 403 supplied with the input encoded speech signal Sens from the data input terminal 401. The demultiplexer 403 demultiplexes the input encoded speech signal Sens into the quantized spectral signal Squs, the quantized power coefficient Cpq, and the quantized K parameters Pqk. The quantized K parameters Pqk, the quantized power coefficient Cpq, and the quantized spectral signal Squs are delivered from the demultiplexer 403 to a K decoding circuit 404, a power decoding circuit 405, and a decoding circuit 406, respectively.

Supplied with the quantized K parameters Pqk, the K decoding circuit 404 decodes the quantized K parameters Pqk into the quantized decoded K parameters Pqdk. The quantized decoded K parameters Pqdk are supplied to a K/∝ converter 407. The K/∝ converter 407 converts the quantized decoded K parameters Pqdk into the decoded parameters Pde∝.

The decoded ∝ parameters Pde∝ are supplied to an assignment section 408. The assignment section 408 comprises a damper 409, a spectral envelope calculator 410, and a bit assignment determiner 411 which are similar to those illustrated in FIG. 1. Therefore, the description of them has been omitted. At any rate, the assignment section 408 produces the bit assignment signal Sbas and the selection signal Ssel. The bit assignment signal Sbas and the selection signal Ssel are supplied to the decoding circuit 406 and a phase information assignor 412.

Supplied with the quantized power coefficient Cpq from the demultiplexer 403, the power decoding circuit 405 decodes the quantized power coefficient Cpq into the quantized decoded power coefficient Cqdp. The quantized decoded power coefficient Cqdp is supplied to the decoding circuit 406.

The decoding circuit 406 decodes the quantized spectral signal Squs on the basis of the bit assignment signal Sbas and the selection signal Ssel by using the quantized decoded power coefficient Cqdp into a spectral signal Ssp indicative of frequency components. It is to be noted that the frequency components of the spectral signal Ssp are classified into first and second groups. That is, each of the frequency components belonging to the first group has the phase information as well as the amplitude information while each of the frequency components belonging to the second group has the amplitude information alone. In other words, the phase information is removed from each frequency component belonging to the second group. The spectral signal Ssp is supplied to the phase information assignor 412.

Figure 5:
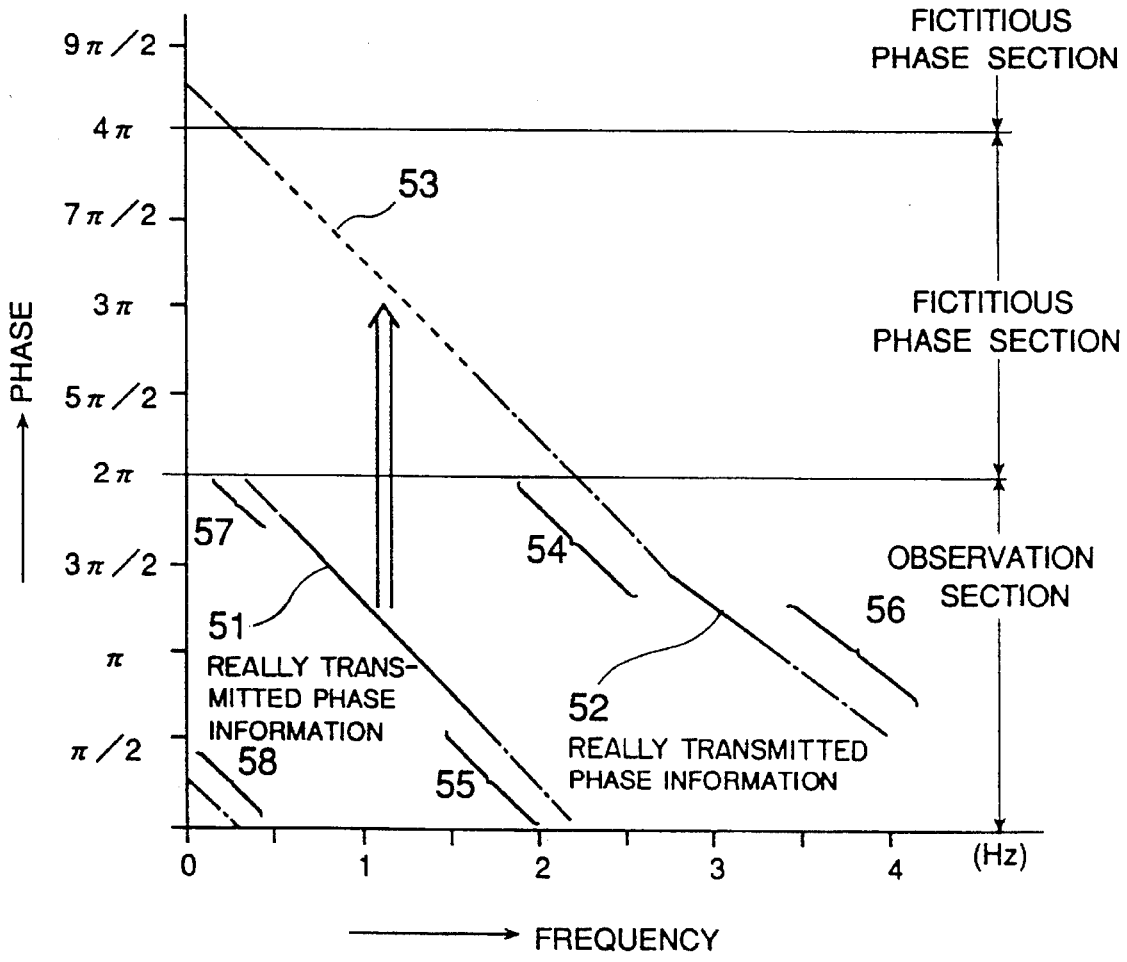
FIG. 5 shows a view for use in describing operation of a phase information assignor in the decoding device illustrated in FIG. 4.

Turning to FIG. 5, description will be directed to operation of the phase information assignor 412. The phase information assignor 412 at first extracts really transmitted phase information from the frequency components in the first group of the spectral signal Ssp. It is assumed that the extracted really transmitted phase information is depicted at solid lines 51 and 52 in an observation section as shown in FIG. 5. Subsequently, the phase information assignor 412 shifts the extracted really transmitted phase information of the solid line 51 from the observation section to fictitious phase sections by an angle which is equal to an integral multiple of $2\pi$ radians as indicated by an arrow so that extrapolated lines of the solid lines 51 and 52 are adjacent to each other to obtain a broken line 53. The phase information assignor 412 generates pseudo-phase information depicted at dot-dash lines 54 and 55 by interpolating between the soild line 52 and the broken line 53 and generates pseudo-phase information depicted at dot-dash lines 56, 57, and 58 by extrapolating the solid lines 51 and 52. The phase information assignor 412 assigns the frequency components in the second group with the pseudo-phase information to produce, as a reproduced complex spectral signal S'csp, a combination of the first group of the frequency components and the second group of the frequency components assigned with the pseudo-phase information. In the manner described above, the phase information assignor 412 generates the pseudo-phase information which is not transmitted by interpolation and/or extrapolation from the really transmitted phase information by means of a minimum phase-shift characteristic of speech that is well known in the art. As a result, the phase information assignor 412 can generate the pseudo-phase information which has a sufficiently high precision. At any rate, the output encoded speech signal Sens is converted into its frequency components with the pseudo-phase information assigned to a part of the frequency components having no phase information.

Turning back to FIG. 4, the reproduced complex spectral signal S'csp is delivered from the phase information assignor 412 to an inverse Fourier transformer 413. The inverse Fourier transformer 413 carries out an inverse Fourier transform on the reproduced complex spectral signal S'csp to successively produce data blocks DB indicative of a whitened speech signal. That is, the frequency components are successively composed to produce the data blocks DB. The data blocks DB are supplied to a buffer memory 414. The buffer memory 414 temporarily stores the data blocks DB each of which is supplied from the inverse Fourier transformer 413 every 32 ms as stored blocks and reads the stored blocks out thereof at a frequency of 8 kHz as readout data RD. The readout data RD is supplied to a LPC synthesis filter 415.

The LPC synthesis filter 415 is also supplied as filter coefficients with the decoded ∝ parameters Pde∝ from the K/∝ converter 407. The LPC synthesis filter 415 carries out an LPC filtering operation on the readout data RD on the basis of the filter coefficients to produce a reproduced coded signal Srec. Therefore, the LPC synthesis filter 415 may be called a synthesizing arrangement for synthesizing the readout data RD on the basis of the decoded ∝ parameters Pde∝ into the reproduced coded signal Srec. The reproduced coded signal Srec is supplied to a digital-to-analog (D/A) converter 416. The digital-to-analog converter 416 converts the reproduced coded signal Srec in synchronism with a predetermined sampling frequency $f_s$, e.g. 8 kHz into an analog speech signal Sans. The analog speech signal Sans is supplied to a low-pass filter (LPF) 417 having the predetermined cutoff frequency $f_c$, e.g. 34 kHz. The low-pass filter 417 carries out a low-pass filtering on the analog speech signal Sans to produce a low-pass filtered signal having the frequency band which is restricted to the predetermined cutoff frequency $f_c$. The low-pass filter 417 is connected to the speech output terminal 402 which therefore produces the low-pass filtered signal as the output speech signal Sous. As described above, the data blocks DB are coupled to produce the replica of the input speech signal Sins.

While this invention has thus far been described in conjunction with a preferred embodiment thereof, it will now be readily possible for those skilled in the art to put this invention into practice in various other manners.

What is claimed is:

1. A method of encoding an input speech signal into an output encoded speech signal by means of an adaptive transform coding technique and of decoding said output encoded speech signal into a replica of said input speech signal, said method comprising the steps of:

partitioning said input speech signal into data blocks by using a time window;

decomposing each of said data blocks into a plurality of frequency components by means of an orthogonal transformation;

adaptively quantizing said frequency components on the basis of intensity of a spectral envelope of the data block in question into said output encoded speech signal with phase information selectively removed from a part of said frequency components that has intensity less than a predetermined level;

converting said output encoded speech signal into said frequency components with pseudo-phase information assigned to a part of said frequency components having no phase information;

composing said frequency components to successively produce said data blocks; and coupling said data blocks to produce said replica of the input speech signal.

2. An an encoding device for use in encoding an input speech signal into an output encoded speech signal, said encoding device comprising:

sampling means (103, 104) for sampling said input speech signal at a predetermined sampling frequency to produce a sampled signal, said sampling means converting said sampled signal into a digitally coded signal;

analyzing means (105) connected to said sampling means for analyzing said digitally coded signal into quantized K parameters, decoded ∝ parameters, a quantized power coefficient, and a quantized decoded power coefficient;

whitening means (111, 112) connected to said sampling means and said analyzing means for whitening said digitally coded signal on the basis of said decoded ∝ parameters to produce a whitened signal;

partitioning means (113) connected to said whitening means for partitioning said whitened signal into data blocks;

transforming means (114, 115) connected to said partitioning means for transforming each of said data blocks into complex and scalar spectral signals which indicate complex and scalar spectrum for each data block, respectively, said complex spectrum consisting of frequency components each of which has both of phase information and amplitude information while said scalar spectrum consists of frequency components each of which has amplitude information alone;

assignment means (117) connected to said analyzing means for calculating a spectral envelope for each data block on the basis of said decoded ∝ parameters and for determining bit assignment on the basis of said spectral envelope to produce a bit assignment signal indicative of said bit assignment and a selection signal indicating whether or not the phase information is removed from each frequency component;

quantizing means (116) connected to said assignment means, said transforming means, and said analyzing means for selectively quantizing, in response to said selection signal, one of said complex and said scalar spectral signals on the basis of said bit assignment signal by using said quantized decoded power coefficient to produce a quantized spectral signal; and multiplexing means (118) connected to said quantizing means and said analyzing means for multiplexing said quantized spectral signal, said quantized K parameters, and said quantized power coefficient into said output encoded speech signal.

3. An encoding device as claimed in claim 2, wherein said analyzing means comprises:

additional partitioning means (106) connected to said sampling means for partitioning said digitally coded signal into additional data blocks;

an analyzer (107) connected to said additional partitioning means for analyzing each of said additional data blocks into K parameters and a power coefficient;

a K quantizing/decoding circuit (108) connected to said analyzer for quantizing said K parameters into said quantized K parameters and for decoding said quantized K parameters into quantized decoded K parameters;

a K/∝ converter (109) connected to said K quantizing/decoding circuit for converting said quantized decoded K parameters into said decoded ∝ parameters; and a power quantizing/decoding circuit (110) connected to said analyzer for quantizing said power coefficient into said quantized power coefficient and for decoding said quantized power coefficient into said quantized decoded power coefficient.

4. An encoding device as claimed in claim 3, wherein said analyzer is a linear predictive coding (LPC) analyzer, said whitening means comprising an LPC inverse filter.

5. An encoding device as claimed in claim 3, wherein said additional partitioning means is a partition circuit by using a Hamming window.

6. An encoding device as claimed in claim 2, wherein said partitioning means is a partition circuit by using a rectangular window.

7. An encoding device as claimed in claim 2, wherein said transforming means comprises a Fourier transformer (114) connected to said partitioning means for carrying out a Fourier transform on each of said data blocks to produce said complex spectral signal and a scalar spectral calculator (115) connected to said Fourier transformer for converting said complex spectral signal into said scalar spectral signal.

8. An encoding device as claimed in claim 2, wherein said assignment means comprises:

a damper connected to said analyzing means for multiplying said decoded ∝ parameters by a damping factor to produce damped ∝ parameters;

a spectral envelope calculator connected to said damper for calculating spectral envelope data representative of said spectral envelope for each data block by processing said damped parameters; and a bit assignment determiner connected to said spectral envelope calculator for determining said bit assignment on the basis of said spectral envelope data to produce said bit assignment signal and said selection signal.

9. An encoding device as claimed in claim 8, wherein said bit assignment determiner comprises:

a logarithm calculator (201) connected to said spectral envelope calculator for carrying out a logarithm operation on said spectral envelope data within a predetermined range to produce logarithmic spectral envelope data;

a maximum searcher (202) connected to said logarithm calculator for searching said logarithmic spectral envelope data to detect a maximum value thereamong;

a segmentation circuit (203) connected to said logarithm calculator and said maximum searcher for segmenting said logarithmic spectral envelope data on the basis of said maximum value into a plurality of sections;

a counter (204) connected to said segmentation circuit for counting count numbers of said logarithmic spectral envelope data within the respective sections;

a maximum quantization bit number determiner (205) connected to said counter for determining a maximum quantization bit number on the basis of said count numbers; and a bit assignor (206) connected to said maximum quantization bit number determiner and said segmentation circuit, said bit assignor producing both said bit assignment signal and said selection signal, said signals being input to said quantizing means.

10. A decoding device for use in combination with the encoding device of claim 2, to decode said output encoded speech signal into an output speech signal as a replica of said input speech signal, said decoding device comprising:

demultiplexing means (403) for demultiplexing said output encoded speech signal into said quantized spectral signal, said quantized power coefficient, and said quantized K parameters;

a K decoding circuit (404) connected to said demultiplexing means for decoding said quantized K parameters into said quantized decoded K parameters;

a K/∝ converter (407) connected to said K decoding circuit for converting said quantized decoded K parameters into said decoded ∝ parameters;

assignment means (408) connected to said K/∝ converter for calculating a spectral envelope for each data block on the basis of said decoded ∝ parameters and for determining bit assignment on the basis of said spectral envelope to produce a bit assignment signal indicative of said bit assignment and a selection signal indicating whether or not the phase information is removed from each frequency component;

a power decoding circuit (405) connected to said demultiplexing means for decoding said quantized power coefficient into said quantized decoded power coefficient;

a decoding circuit (406) connected to said power decoding circuit, said assignment means, and said demultiplexing means for decoding said quantized spectral signal on the basis of said bit assignment signal and said selection signal by using said quantized decoded power coefficient into a spectral signal indicative of frequency components which are classified into first and second groups, each of the frequency components belonging to said first group having the phase information as well as the amplitude information while each of the frequency components belonging to said second group has the amplitude information alone;

a phase information assignor (412) connected to said decoding circuit and said assignment means for assigning pseudo-phase information to the frequency components of said second group to produce, as a reproduced complex spectral signal, a combination of said first group and said second group assigned with said pseudo-phase information;

inverse transforming means (413) connected to said phase information assignor for inverse transforming said reproduced complex spectral signal into data blocks indicative of a whitened speech signal;

a buffer memory (414) connected to said inverse transforming means for temporarily storing said data blocks and reading said stored data blocks out thereof as readout data;

synthesizing means (415) connected to said buffer memory and said K/∝ converter for synthesizing said readout data on the basis of said decoded ∝ parameters into a reproduced coded signal; and converting means (416, 417) connected to said synthesizing means for converting said reproduced coded signal into said output speech signal.

11. A decoding device as claimed in claim 10, wherein said synthesizing means is a LPC synthesis filter.

12. A decoding device as claimed in claim 10, wherein said inverse transforming means comprises an inverse Fourier transformer.

13. A decoding device as claimed in claim 10, wherein said assignment means comprises:

a damper connected to said K/∝ converter for multiplying said decoded ∝ parameters by a damping factor to produce damped parameters;

a spectral envelope calculator connected to said damper for calculating spectral envelope data representative of said spectral envelope for each data block by processing said damped parameters; and a bit assignment determiner connected to said spectral envelope calculator for determining said bit assignment on the basis of said spectral envelope data to produce said bit assignment signal and said selection signal.

14. A decoding device as claimed in claim 10, wherein said phase information assignor calculates said pseudo-phase information by interpolation and/or extrapolation from phase information which is extracted from the frequency components in said first group of said spectral signal.

15. In an encoding/decoding device comprising a speech signal input terminal (101) for inputting an input speech signal, a speech analyzer section (100) for encoding said input speech signal supplied with said speech signal input terminal into encoded speech signal data by means of an adaptive orthogonal transformation, a data output terminal (102) for outputting said encoded speech signal data encoded by said speech analyzer section, a data input terminal (401) for inputting said encoded speech signal data delivered from said data output terminal, a speech synthesizer section (400) for decoding said encoded speech signal data supplied from said data input terminal into an output speech signal, and a speech signal output terminal (402) for outputting said output speech signal supplied from said speech synthesizer section, the improvement wherein:

said speech analyzer section includes:

spectral envelope intensity estimating means (120) for estimating intensity of a spectral envelope of said input speech signal; and means (115, 116, 121) for encoding frequency components into which said input speech signal is decomposed by said adaptive orthogonal transformation with phase information selectively removed from a part of said frequency components on the basis of said intensity of the spectral envelope estimated by said spectral envelope intensity estimating means;

said speech synthesizer section including:

means (412) for assigning pseudo-phase information to each of the frequency components from which said phase information is selectively removed.

16. An encoding/decoding device as claimed in claim 15, wherein said phase information assigning means including means for calculating said pseudo-phase information by interpolation and/or extrapolation from phase information included in said encoded speech signal data that is really carried from said speech analyzer section to said speech synthesizer section.

17. In an encoding device comprising a speech signal input terminal (101) for inputting an input speech signal, a speech analyzer section (100) for encoding said input speech signal supplied with said speech signal input terminal into encoded speech signal data by means of an adaptive orthogonal transformation, and a data output terminal (102) for outputting said encoded speech signal data encoded by said speech analyzer section, the improvement wherein said speech analyzer section includes:

spectral envelope intensity estimating means (120) for estimating intensity of a spectral envelope of said input speech signal; and means (115, 116, 121) for encoding frequency components into which said input speech signal is decomposed by said adaptive orthogonal transformation with phase information selectively removed from a part of said frequency components on the basis of said intensity of the spectral envelope estimated by said spectral envelope intensity estimating means.

18. In a decoding device for use in combination with the encoding device of claim 17, said decoding device comprising a data input terminal (401) for inputting said encoded speech signal data, a speech synthesizer section (400) for decoding said encoded speech signal data supplied from said data input terminal into an output speech signal, and a speech signal output terminal (402) for outputting said output speech signal supplied from said speech synthesizer section, the improvement wherein said speech synthesizer section includes:

means (412) for assigning pseudo-phase information to each of the frequency components from which said phase information is selectively removed.

* * * * *